United States Patent [19]

Nuber et al.

[11] Patent Number: 4,846,642

[45] Date of Patent: Jul. 11, 1989

[54] ROTARY PISTON BLOWER WITH FOAMED SYNTHETIC MATERIAL SURFACES RUNNING ALONG ROUGHENED METAL SURFACES

[75] Inventors: Roland Nuber; Werner Schubert, both of Lindau; Wolfgang Sohler, Wangen, all of Fed. Rep. of Germany

[73] Assignee: Wankel GmbH, Berlin, Fed. Rep. of Germany

[21] Appl. No.: 118,290

[22] Filed: Nov. 6, 1987

[30] Foreign Application Priority Data

Nov. 8, 1986 [DE] Fed. Rep. of Germany ..... 3638183
Apr. 11, 1987 [DE] Fed. Rep. of Germany ..... 3712354

[51] Int. Cl.[4] ..... F04C 18/16; F04C 18/18; F04C 29/00

[52] U.S. Cl. ..... 418/152; 418/178; 418/179; 418/201; 418/206; 418/151

[58] Field of Search ..... 418/152, 153, 178, 206, 418/179, 201 R; 29/156.4 R, 156.4 WL

[56] References Cited

U.S. PATENT DOCUMENTS

| | | | |
|---|---|---|---|
| 2,103,524 | 12/1937 | Ernst | 418/206 |
| 2,491,677 | 12/1949 | McCulloch | 418/152 |
| 2,754,050 | 7/1956 | Wellington | 418/153 |
| 2,999,466 | 9/1961 | Hornschuch et al. | 418/201 R |
| 3,126,834 | 3/1964 | Bursak | 418/206 |
| 3,396,667 | 8/1968 | Schmitt | 418/152 |
| 3,558,246 | 1/1971 | Philipp | 418/153 |
| 3,801,241 | 4/1974 | Martin et al. | 418/152 |
| 4,466,785 | 8/1984 | Biswas | 418/152 |

FOREIGN PATENT DOCUMENTS

| | | | |
|---|---|---|---|
| 56-75992 | 6/1981 | Japan | 418/178 |
| 61-79883 | 4/1986 | Japan | 418/178 |

*Primary Examiner*—John J. Vrablik
*Attorney, Agent, or Firm*—Becker & Becker, Inc.

[57] ABSTRACT

A gap seal formed between surfaces cooperating with each other such that operation free of engagement between the cooperating rotor and housing parts with respect to each other at relative speeds occurs subject to a roughened light-metal surface of one part cooperating with a covering of foamed synthetic material on the other part so as to assure gap seal therebetween rather than having any metal-to-metal and/or foamed-material to foamed-material interengagement. The foamed synthetic material covering of a surface preferably is made of polyurethane and the light-metal surface is made of aluminum roughened by sandblasting or etching. The lightweight metal part can have cavities and recess spaces therein to be filled with foamed material as well as other fins, ribs, and anchoring provision for holding the foamed synthetic material bodies in place. The applicability of the cooperating surfaces of lightweight metal parts and foamed synthetic material parts includes rotary piston engines having different configuration of lobes of rotating pistons as well as cooperating surfaces of a spiral compressor and also a screw compressor for delivery of working medium free of oil and bearing grease.

8 Claims, 6 Drawing Sheets

ROTARY PISTON BLOWER WITH FOAMED SYNTHETIC MATERIAL SURFACES RUNNING ALONG ROUGHENED METAL SURFACES

BACKGROUND OF THE INVENTION

1. Field of the Invention

The present invention relates to a rotary piston blower with working-parts or blocking-off parts as well as working-chamber walls among themselves forming a gap seal as the moving parts approach and run free of engagement with relative speed with respect to each other.

2. Description of the Prior Art

A vast number of types and variations of such machines exists, whereby however only a very limited number have attained practical meaning and maintain themselves. These are the external-axis machines like the Roots-type, the semi- and quarter-roller blowers and internal-axis machines operating in meshing engagement as well as screw compressors. In common for all is that spaces decreasing and increasing in volume are enclosed or shifted, in other words changing, between the working chamber walls and the working-or blocking off parts including rotors pistons or propellers (screws). An engagement-free running-up of the parts forming the working chamber is necessary in order to avoid the frictional losses with direct running-up and in order to be able to keep the operating or working chamber and with that the conveyed working medium free of oil.

Gap widths of a few tenths millimeters are attainable in mass production between the machine parts forming the working chamber. With a coating of synthetic material with good slide characteristics as described in German Offenlegungsschrift No. 36 21 178.8 corresponding to U.S. patent application Ser. No. 064,993-Sohler, filed June 19, 1987, copending herewith and belonging to the assignee of the present invention, very much better results are attainable, since such a coating or layering can cut or grind itself in operation up to a gap of a few hundredths of a millimeter. The coating or layering however can be applied accurately measured to dimension on the raw piston parts only subject to greater manufacturing and fabrication difficulties and requires a considerable machining via truing, turning or finishing and the like, although most of all having the disadvantage, that such coating or layering under influence of operating heat which can attain 120° C. and more, so that separation and release occurs due to centrifugal force effect.

There is further known that a covering or incrustation of carbon or carbonaceous material forms on the working chamber walls with the drive part of rotary piston exhaust superchargers, which covering or incrustation on the running-up surfaces of the working-chamber-forming parts in operation automatically runs-in during operation to a most narrow gap. This however is possible simply only with exhaust machines or exhaust superchargers and is not a constructive feature on the machine parts themselves, but rather only a procedure effective upon carbon covering or incrustation in a natural manner which is a incidental result and uncertain to occur.

SUMMARY OF THE INVENTION

An object of the present invention is to provide a construction of working-chamber-forming parts of the aforementioned machines to permit the greatest possible precision without increased-construction and cost-expenditure, most of all without subsequent reworking after forming-out or formation to form the closest or narrowest sealing-off gaps among each other and also withstanding higher operating temperatures.

This object is fulfilled for the aforementioned rotary piston blowers via features and arrangements set forth in the following disclosure.

BRIEF DESCRIPTION OF THE DRAWINGS

This object, and other objects and advantages of the present invention, will appear more clearly from the following specification in conjunction with the accompanying drawings.

DESCRIPTION OF PREFERRED EMBODIMENTS

Figure 1:
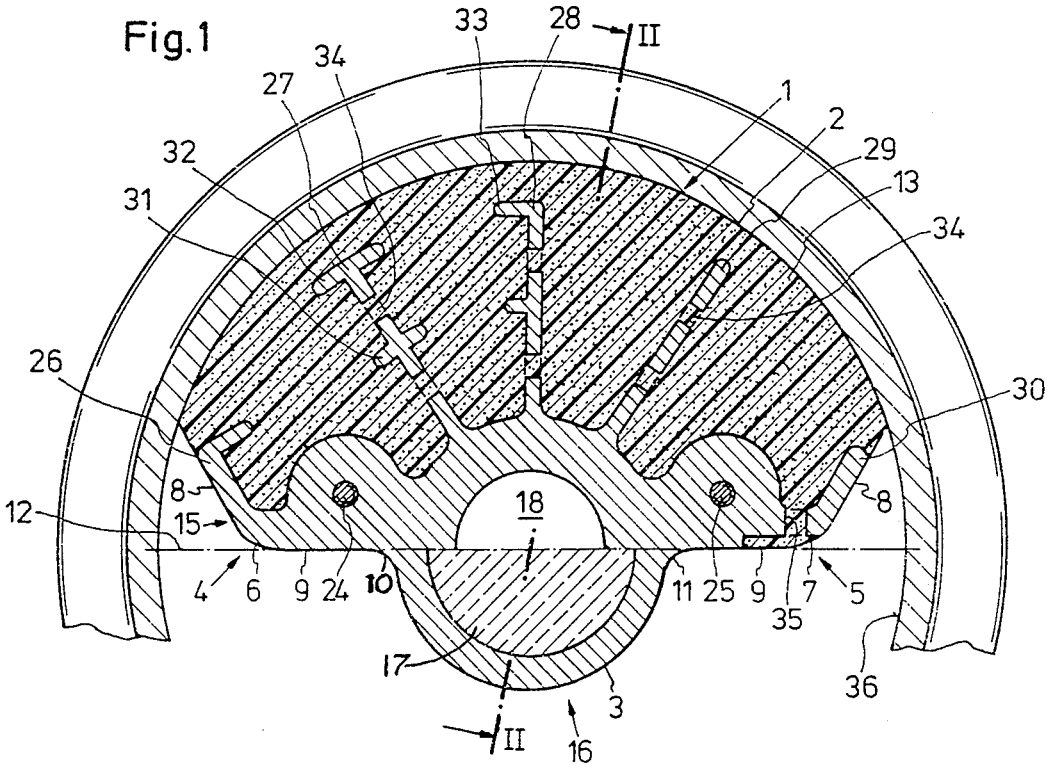
FIG. 1 is a view that shows a radial section through a piston of half-roller type of construction in accordance with the present invention as seen in a plane I—I in FIG. 2.

Referring now to the drawings in detail, the piston of the half-roller type of construction illustrated in FIG. 1 has a lobe or vane 1 with a curved or cylinder surface 2 with a large radius as well as a curved or cylinder surface 3 with a small radius. The curved or cylinder surface 2 with a large radius extends over 135° and the curved or cylinder surface 3 with a small radius extends over 180°, as measured with a cylinder axis as a center or midpoint. Symmetrical engagement surfaces 4 and 5 are provided between the two curved or cylindrical surfaces 2 and 3; the engagement surfaces 4 and 5 respectively are bent-away outwardly in an angle of 120° around a convex curve 6 respectively 7 and consisting respectively of an outer smooth or even engagement surface 8 and a smooth or even inner engagement surface 9. The inner engagement surfaces 9 have a transition in concave curves 10 and 11 into the curved or cylinder surface 3 with smaller radius. The outer smooth and even engagement surfaces 8 intersect the curved or cylinder surface 2 in a blunt or obtuse angle of 120°. The inner engagement surfaces 9 are located accordingly in a dividing or separating plane 12 between the lobe or vane 1 and the curved or cylinder surface 3 with the small radius.

The lobe or vane 1 in essence consists of a synthetic material body 13 of foamed polyurethane, which along outer walls thereof forms a solid or rigid non-porous wall, since formation thereof occurs via foaming in a closed tool and consequently the synthetic material foam compresses and solidifies according to the walls of the tool as far as to extensive freedom from pores as a consequence of inner pressure thereof. A forced introduction of the drive pin 14 in FIG. 2 into this synthetic material body 13 occurs via a section or segment of a strand-pressed light-metal (aluminum) profile 15 formed into the synthetic material body 13.

Figure 2:
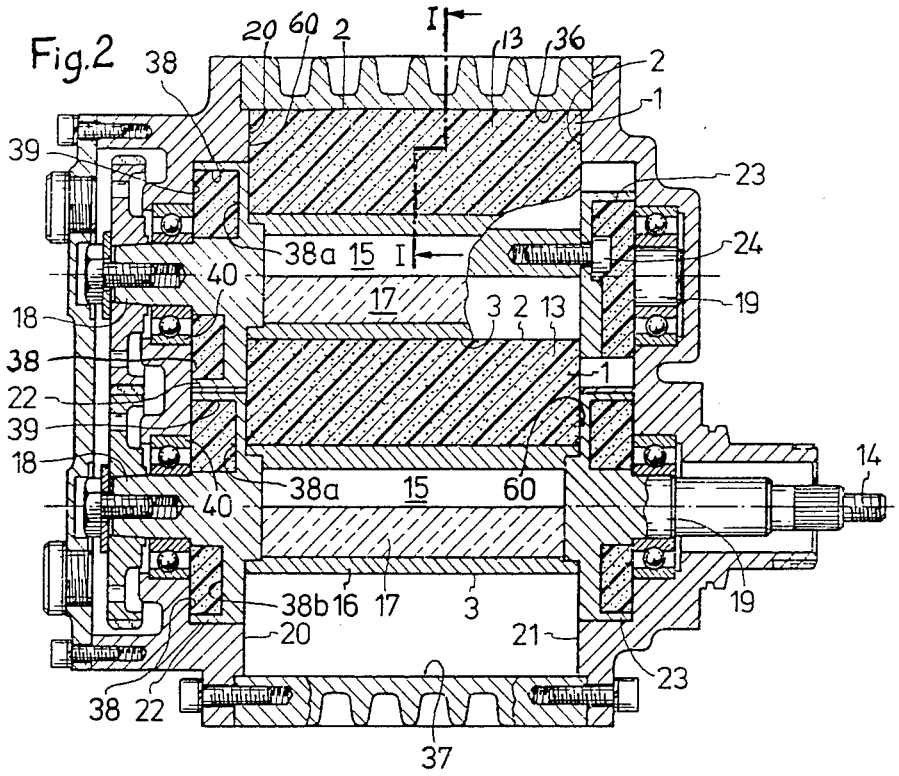
FIG. 2 is a view that shows an axial section through a blower having half-roller type of construction in accordance with the present invention as seen in a plane II—II in FIG. 1.

The piston part 16 forming the curved or cylinder surface 3 with a small radius is part of a strand-pressed light-metal profile 15 and is filled with lead or metal as a counterweight 17 relative to the lobe or vane 1. Shaft pins or pivots 18 on the left side and 19 on the right side are installed in axial flanks of the light-metal profile 15 as shown in FIG. 2 and disks or plates 22, 23 are provided therewith running in recesses in the housing sidewalls 20, 21. Shaft butts or ends are screwed or threaded at 24 with the disks or plates 22, 23 relative to the light-metal profile 15.

The synthetic material body 13 is anchored in the light-metal profile 15 in ribs 26, 27, 28, 29 30 thereof. These ribs or fins 26, 27, 28, 29, 30 are illustrated in FIG. 1 in different embodiments and configurations. The ribs can have lateral anchoring ribs or projections 31, 32, 33 and interruptions, perforations or break-throughs 34 in these ribs. Consequently adequate and sufficient shaped undercuts are formed in which the very rigid and solid synthetic body 13 is securely held against centrifugal forces resulting and occurring during operation. The ribs 26, 27, 28, 29, 30 extend axially just like the achoring ribs 31, 32, 33 and can be withdrawn or drawn-out without difficulty during strand pressing or extrusion of the light-metal profile 15. During the foaming, the synthetic material enters into all hollow spaces and chambers as well as undercuts of the light-metal profile so that during hardening and curing there results a homogeneous piston that can take up all forces arising in operation and that can pass along and convey and transmit all such forces that arise during operation.

Outer ribs 26 and 30 in the embodiment illustrated in FIG. 1 simultaneously are part of the external or outer engagement surface 8. Likewise the inner engagement surface 9 is formed by the light-metal profile 15. These two engagement surfaces 8 and 9 have no sealing function and consequently can be left out of consideration The sealing during the transition of the rolling-off of curved or cylinder surfaces 2 and 3 on both sides is taken over by the convex curves 6 respectively 7 between the engagement surfaces 8 and 9 approaching to run along each other free of engagement for sealing-off of the leakage pass between the two pistons. Of these curves, the right curve 7 of the piston illustrated in FIG. 2 is formed of the same foam as that of the foamed body 13 during the foaming-out thereof through passage through the interruptions or perforations 35 in the light-metal profile 15. The left curve 6 of the piston in contrast consists of metal. With the counter piston conversely the left curve 6 is made of foam corresponding to the curve 7 of the piston illustrated in FIG. 3 while the right curve 7 of the counter piston consists of metal. Consequently always one curve of foam runs along a curve of aluminum of the counter piston.

The casing or mantle surface locations 36 and 37 of the housing according to FIG. 2, the curved or cylinder surfaces with the small radius, the metallic curve 6 of one piston as well as the metallic curve 7 of the counter piston are roughened by sandblasting, so that always a foamed surface is paired with a roughened aluminum surface and can grind or run-in there along but never however having any foam in engagement with foam and also never having any metal in engagement with metal. This means that with all surfaces approaching and running in a sealing-off manner relative to each other always metal meets or impinges upon foamed material.

Since the light-metal or aluminum profile 15 adjoins or engages along those surfaces of the foamed material body 13 including the curves 6 respectively 7, likewise having to be roughened via sandblasting, in order to enlarge the binding or connecting surface, there is noted that the lightmetal or aluminum profile 15 can be sandblasted on all sides in one operation or working step. The same is possible during etching via immersion or dipping of the light-metal or aluminum profile 15.

The casing or housing sealing-off relative to the shaft passages in the sidewalls 20, 21 occurs via disks or plates 22, 23, which are arranged concentrically around the shaft drive pin means 18, 19. According to previous technique the sealing-off in the narrowest gap spaces between the peripheral surfaces of these disks or plates 22, 23 and the recesses thereof in the housing sidewalls 20, 21 existed because these gap spaces could be produced more easily by turning-out, cutting or boring than the gaps located in a radial plane between the bottom or base of these recesses or turned-out portions and the disks or plates 22, 23. The object of this seal is not only the hindrance and prevention of leakage of pressure gases but rather also the prevention of penetration of bearing grease and lubricating oil into the operating or working chambers during underpressure therein relative to the bearing chambers and drive chambers. Penetrating oil results in undesired oil contents in conveyer, discharge or feed gas. A withdrawal of the bearing grease leads to a dry running of the bearing. The gap seals on the periphery of the disks or plates 22, 23, accordingly such a gap seal of metal against metal, permits only gaps of tenths of a millimeter. According to the invention there are provided concentrically extending recesses 38 in the disks or plates 22, 23 and these concentrically extending recesses 38 are foamed-out or filled with foam just as the lobes or vanes 1 of the piston means are filled with synthetic material in a pressure casting or die casting procedure. These recesses 38 are of different depths in order to allow the disks or plates 22, 23 to be effective as counterweights. Recesses 38 forming a semi-circular ring **38*a* on the side of the lobes or vanes 1 are deeper axially than the other semi-circular ring-forming recesses 38*b* on the side of a piston part 16 with the small radius. The difference results from the necessary or required mass of the equalization, compensating or balancing weights which can be adapted, adjusted or lined-up in this manner. The counter-running surfaces 39 of these foamed configurations as well as the edges of the shaft bearing rings 40** are roughened like the aforementioned metallic running surfaces so that a running-in or grinding of this shaft-passage seal results to hundredths of a millimeter dimensionally. This arrangement accordingly in most situations saves and eliminates need further features or measures for hindrance or prevention of entry or passage of lubricating means or medium into the operating or working chambers.

Figure 3:
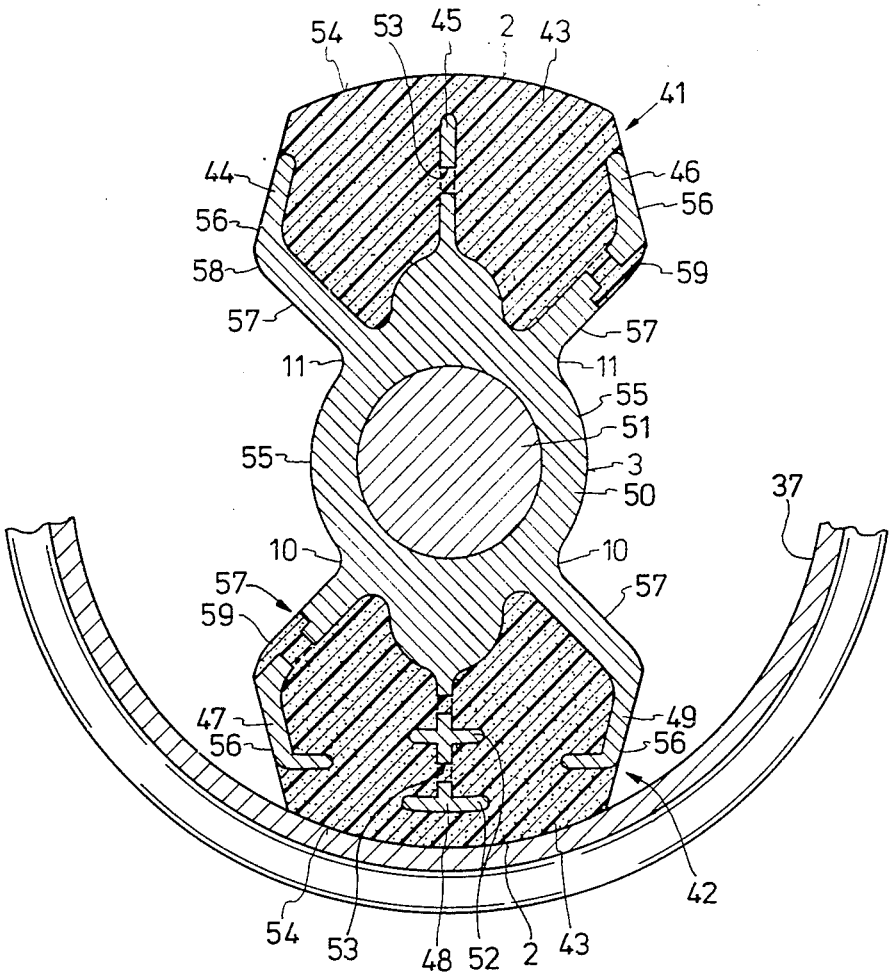
FIG. 3 is a view that shows a radial section through a piston of quarter-roller type of construction in accordance with the present invention.

The piston of the quarter-type of construction illustrated in FIG. 3 is radially symmetrical and consequently requires no balancing or compensation of the two lobes or vanes 41 and 42 thereof. These lobes or vanes 41 and 42 in the same manner as the lobe or vane 1 all include an arrangement that consists of the two foamed-material bodies 43 and an aluminum or light-metal profile 50 anchored via foaming in a die casting method or procedure with respect to ribs or fins 44, 45, 46, 47, 48, 49. This light-metal profile 50 is here the carrier or support of the two foam-material bodies 43 and transmits the force of the shaft 51 arranged thereon in this manner. The ribs or fins 44, 45, 46, 47, 48, 49 extending continuously in axial direction have anchors or retaining means 52 which just like the ribs or fins themselves can have different shapes or forms, of which examples are shown in FIG. 1. Perforations or break-throughts 53 are provided in these ribs or fins and have the same object as the perforations or break-throughs throughs 34 as represented in FIG. 1.

The engagement surfaces 56 and 57 provided between the curved or cylinder surfaces 54 with a large radius and the curved or cylinder surfaces 55 with a small radius and the curves or rounded-off portions 58 and 59 located therebetween have the same geometry as those of the half-roller lobe or vane illustrated in FIG. 1. Corresponding to the requirement that always foam-material surfaces are to approach or run along roughened metal surfaces there is noted that the curved or cylinder surfaces 54 with a large radius are formed of foamed material and the curved or cylinder surfaces 55 with a small radius however are formed of roughened metal. The same is true for the convex curves or rounded-off portions 56 with both piston lobes or vanes of roughened metal while the curve or rounded-off portions 57 on the other side of the piston lobe or vane consist of foamed material. The connection of the latter with the foamed-material bodies 43 is the same as with the pistons of a half-roller machine illustrated in FIG. 1. Also the production method or procedure of such piston means is the same as was previously described. These convex curves or rounded-off portions with the counter piston must consist homologously or mirror-inverted of foamed material respectively of metal so that always a curve or rounded-off portion of foamed material runs or approaches along such a curve or rounded-off portion of metal and can run-in or grind itself complementary thereto. Finally, it is effective, practical, advantageous and expedient also to have the casing or mantle runways 36 and 57 of the housing or casing as well as the housing sidewalls 20 and 21 with the half-roller machine illustrated in FIGS. 1 and 2 and likewise the housing inner walls of the quarter-roller machines to be roughened in the same manner as the metallic surfaces of the piston means, which approach or run along the foamed material in order here also to pair the foamed material with the roughened material such that particularly the sides or flanks of the piston means can be ground or run-in in this manner.

Figure 4:
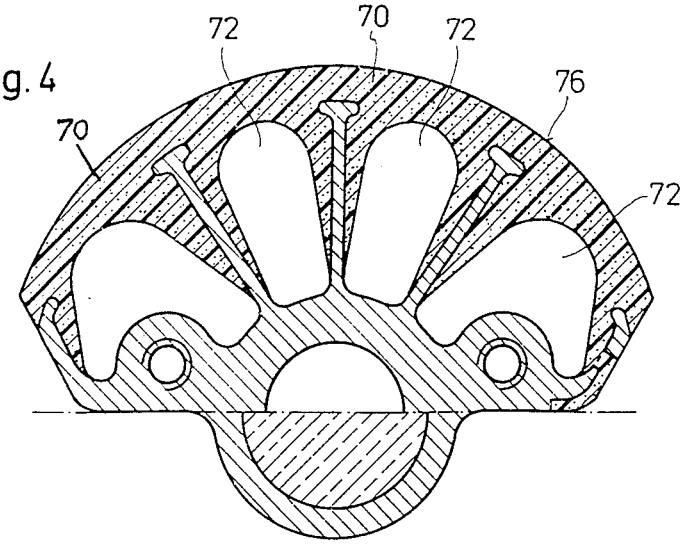
FIG. 4 is a view that shows another embodiment of a piston of a half-roller blower in radial section having features in accordance with the present invention.
Figure 5:
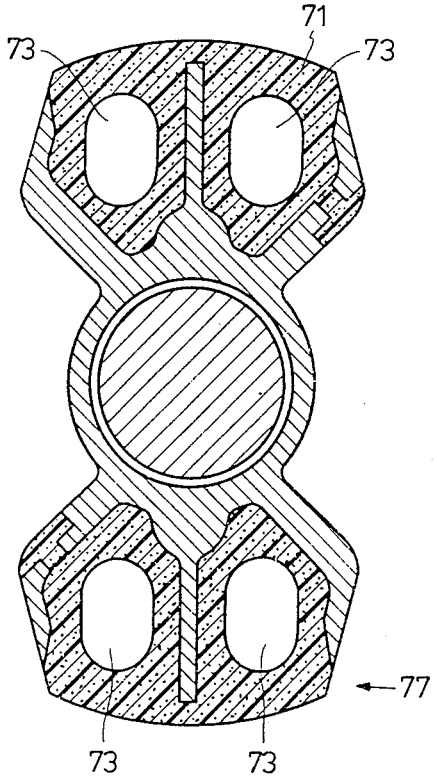
FIG. 5 is a further embodiment of a piston of a quarter-roller blower take in radial section having features in accordance with the present invention.

FIGS. 4 and 5 show embodiments of inventively foamed-out piston means of a half-roller blower respectively quarter-roller blower with which hollow spaces or chambers 72 respectively 73 are formed in the foamed-material body 70 in FIG. 4 and foamed-material body 71 in FIG. 5 via mold cores installed in the foaming-out tool. These mold cores after hardening of the foamed material can be easily removed or withdrawn axially out of the hardened polyurethane foam for example.

Figure 6:
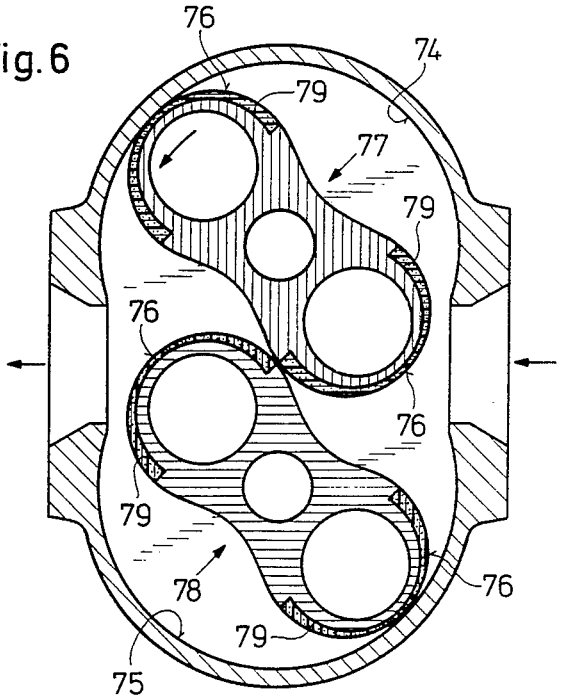
FIG. 6 is a view that shows a radial section taken through an inventive Roots-blower.

FIG. 6 represents a conventional Roots blower with which convex surfaces 76 of the pistons 77 and 78 moving or running along the housing or casing runway 74, 75 are formed of foamed material bodies 79. The concave surfaces of the pistons between foamed material bodies 79 are formed of roughened metal surfaces. These foamed material bodies 79 in any case can be anchored to the aluminum piston corresponding to the aforementioned description of the half-rotor blower and quarter-rotor blower with ribs. Also here a foamed material surface always runs along metal surfaces which must have been roughened in the aforementioned and described manner.

Figure 7:
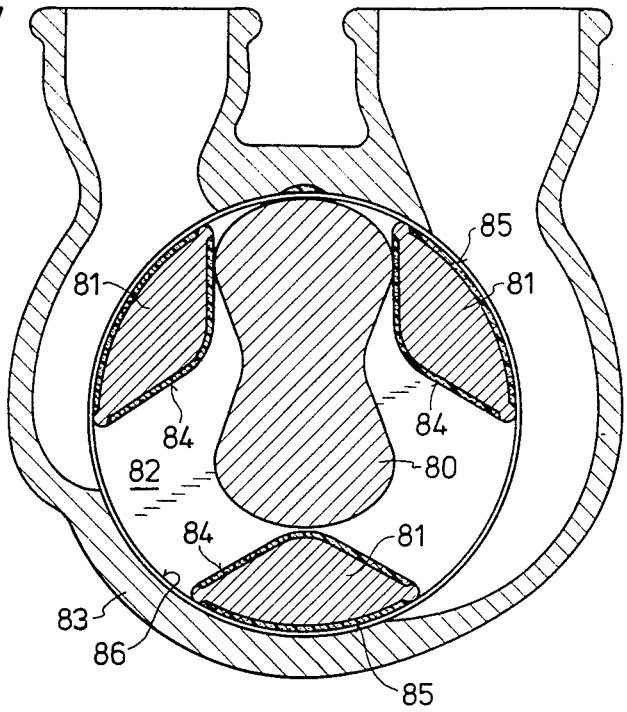
FIG. 7 is a view that shows a radial section through a rotary piston blower operating in meshing engagement and having features in accordance with the present invention.

FIG. 7 shows a rotary piston blower operating in meshing engagement and which is formed by a piston 80 corresponding to the piston of the aforementioned Roots-blower and a counter-running configuration 82 having three block-off parts 81, which revolve or rotate in a cylindrical housing 83. The piston 80 runs along the inner surfaces of the block-off parts 81 which are clad or covered with inventive foamed material on the running surfaces 84. The block-off parts 81 in turn run along the curved or cylinder surfaces 85 on the casing or housing runway 86 clad with foamed material. Here there is shown that the foamed material bodies, which form the surfaces 84, are pressed by centrifugal forces against the block-off parts 81 carrying such surfaces 84. Consequently only the foamed material bodies, which form the surfaces 85, need to have a special anchoring. However, also the housing or casing runway 86 rather than the curved or cylinder surfaces 85 of the block-off parts 81 need to be covered or coated with foamed material in order also here to utilize the centrifugal force effect, which however requires a greater constructive cost and complexity.

Figure 8:
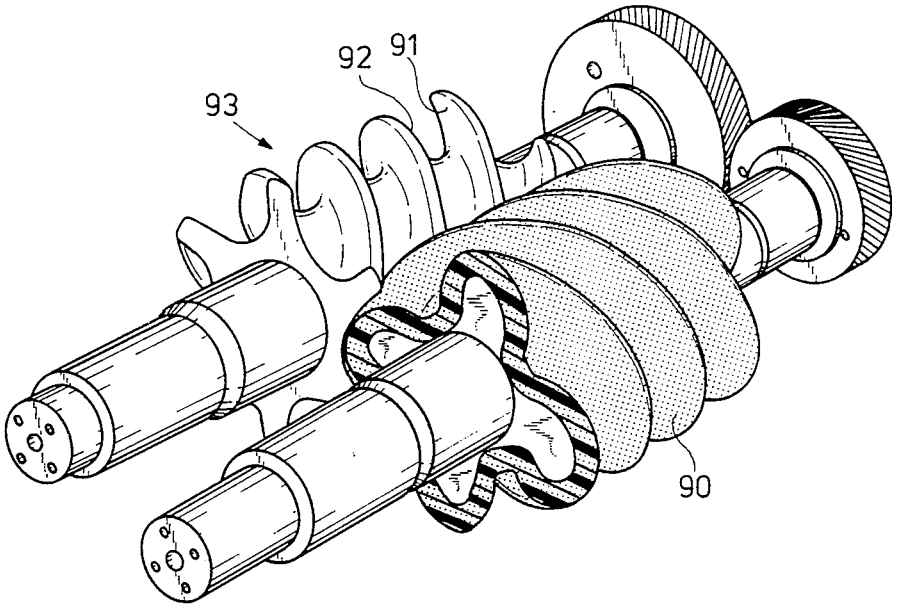
FIG. 8 is a view that shows a perspective representation of a screw compressor in accordance with the present invention.

The perspective view of FIG. 8 represents a screw compressor with which the approach or run-on surface 90 of the one screw to the right in the drawing and the flanks or sides 91 and 92 of the pitch of screw threads or course of threads of the counter screw 93, in a manner similar to that shown in FIG. 6, are clad with foamed synthetic material, while the counter surfaces 90 or 91 and 92 are formed of roughened metal surfaces so that framed material surfaces always run along roughened metal as to the interengaging or meshing and cooperating surfaces.

Figure 9:
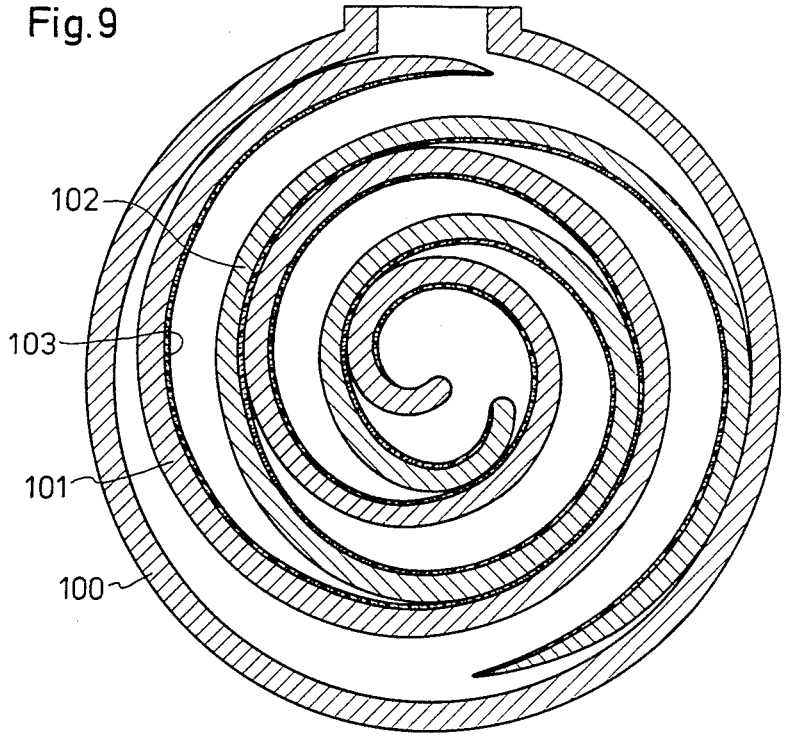
FIG. 9 is a view that shows a radial section taken through a spiral compressor having features in accordance with the present invention.
Figure 10:
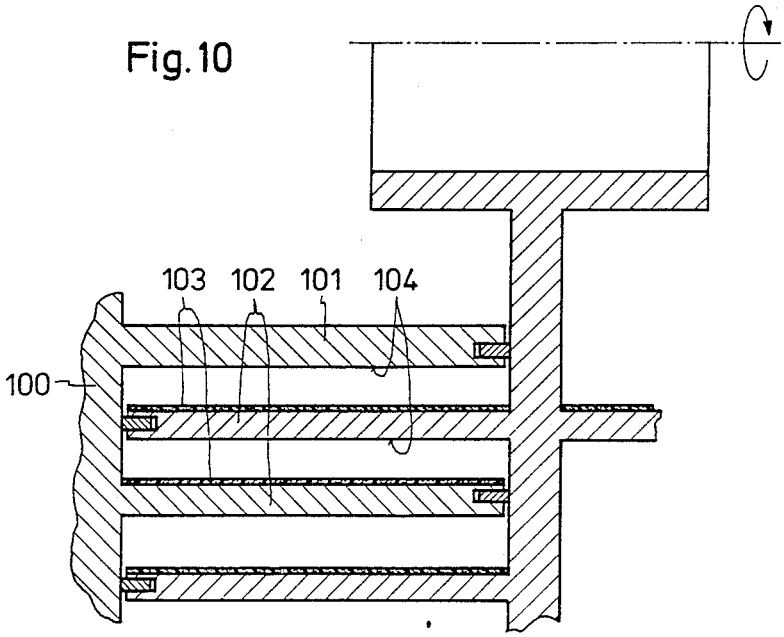
FIG. 10 is a fragmentary view of an axial section taken through a spiral compressor according to FIG. 9.

A known spiral compressor is illustrated in FIGS. 9 and 10 with which the casing or housing 100, the stationary spiral wall 101 in the housing 100 and the rotor 102 are illustrated. The rotor 102 in accordance with the present invention carries along a radially inner wall thereof, that runs along the spiral wall 101 of the housing or casing 100, being provided with a layer or coating 103 of foamed synthetic material, while the counter surface 104 of the wall 101 consists of roughened metal. In this manner care is taken that the foamed material coating or covering is arranged on the centrifugal-force-negative side, accordingly always being pressed by the centrifugal force against the wall carrying such foamed material coating or covering so that no special anchoring is required. Also here the foamed material always runs along the roughened material.

In accordance with the present invention, the parts coated or covered with foamed synthetic material or consisting of foamed synthetic material run-in to operate along the counter surface with the narrowest possible gap or spacing from each other. With that it is expedient and purposeful respectively a surface or edge consisting of foamed synthetic material runs along a counter surface respectively edge or metal, whereby the metal surface is to be so rough that the foamed material counter surface is ground away upon engagement. This roughness, which is to amount to a range of approximately 100 to 150 μm can be produced well and very good with sandblasting but also with etching via which the crystallites allotriomorphic crystal or crystalline grain structure of the metal is exposed. Consequently there is to be avoided, just as metal is to run along and against metal such that foamed material surfaces are to be paired with foamed material surfaces. This roughening of the metallic surfaces which is effective file-like on the synthetic material of which the surface is to be compacted or compressed such that this roughening is necessary, since smooth metal surfaces during direct running along the foamed material result in occurence of only braking or blocking frictional forces and consequently no grinding-in of the foamed material parts can occur. So far as the type of machine permits to this occur there is noted that the foamed material surface is to be arranged on the part upon which a smaller or more nominal centrifugal force is effective than upon the part with the counter surface, in order to reduce the centrifugal force loading of the anchoring of the foamed material parts.

The connection or binding of the foamed material parts to the metal structures carrying the foamed material parts likewise can be improved by production or generation of a roughness of the metal surfaces to be connected with the foamed material very much via the enlargement of the binding surface resulting thereby. This can occur and result via sandblasting or via etching.

Hollow spaces or chambers are to be provided ex pe diently and in a purposeful manner advantageously in larger foamed material parts in order to make possible a heat expansion inwardly in order to keep the changes or variation of the gap width as small as possible via operating temperatures. These hollow spaces or chambers can be produced via axially inserted mold cores during foaming operation.

The machine parts produced in the present inventive manner in essence have the same weight as otherwise conventionally hollow constructed extrusion profiles or shapes of aluminum. Consequently no special arrangements are required for the compensation or balancing thereof.

The production of foamed material parts occurs in external tools, which represent the negative form or shape of the part to be obtained subject to maintaining of corresponding tolerances measured and ascertained accurately as adapted to shrinkage or growth of the foamed material via a foaming-out operation. The metal parts after previous roughening as well as mold cores producing eventual hollow spaces or chambers in the foamed material, which are removed or withdrawn after forming-out, are inserted in these tools as the metal parts to which the foamed material is to be joined or connected. The foamed material preferably is polyurethane foamed with water. A foaming with fluoro, hydrocarbon materials is to be avoided since the fluorine containing gas given off by the foamed material at operating heat corrodes the metal parts of the machine. With the water-foamed polyurethane moreover additionally no heat expansions occur caused by driving medium at operating temperatures.

Finally it is also expedient and purposeful as well as advantageous to heat the tools for the foaming-out operation, since then surfaces adjoining along the tool have a compacting or compression of the foamed material occur which enhances the grinding-in during operation.

The machine parts in accordance with the present invention, since these parts are mostly rotational bodies with axially parallel curved or cylinder surfaces, can be produced out of extruded aluminum parts foamed in the aforementioned manner without further post working or machining. The running-in respectively grinding-in requires only short running times of the machine, whereby the worked-off material of the foamed material precipitates as non-damaging dust and is blown away out of the machine.

The blowers having features in accordance with the present invention consequently are very well adapted and suitable for inexpensive mass production. Also as a consequence of the far reaching tightness, the blowers can provide efficiency, capacity and output which previously could not be produced or brought about by such blowers.

The present invention is, of course, in no way restricted to the specific disclosure of the specification and drawings, but also encompasses any modifications within the scope of the appended claims.

What we claim is:

1. A rotary piston blower having working-parts as well as blocking-off parts including rotors, pistons and the like and working chamber walls including housing sidewalls, casing surface locations and the like forming a gap seal spacing clearance therebetween as well as permitting running operation in a manner free of engagement due to the clearance as well as with relative speed as to each other during the running operation, comprising:

respectively one of the parts running along another part, said one part having running surfaces being formed of foamed synthetic materials; and counter surfaces consisting of roughened metal on said another part which move along said running surfaces on said one part during running operation.

2. A rotary piston blower according to claim 1 including an external-axis rotary piston blower that is one of a half-type or quarter-type designation as to the extent of piston peripheral configuration of construction with a housing consisting of sidewalls and two curved inner cylinder surfaces forming housing runways intersecting each other, said housing having piston shaft means passing axially therethrough and including inlets and outlets provided in the intersection zones of the curved inner cylinder surfaces, relative to which the pistons roll along respectively roll-off free of engagement so that lobes having outer convex rounded-off portions with respect to a curved inner cylinder surface with a large radius move relative to the housing runways and also on another curved cylinder surface with a small radius, said convex rounded-off portions merging into complementary transitional and concave cooperating surfaces located between the curved cylinder surfaces of the respective other piston, whereby the lobes of the piston include segments of a light-metal profile having radial ribs with anchoring provided in segments thereof and in this light-metal profile consisting of foamed-in bodies conforming to an outer shape of running approach surfaces of foamed synthetic material of the lobes reproduced via a die casting tool.

3. A rotary piston blower according to claim 2 in which the complementary transitional and concave cooperating surfaces of the pistons are formed by the light-metal profile and furthermore the convex rounded-off portions on one side of a lobe of the pistons are formed by foamed synthetic material.

4. A rotary piston blower according to claim 1 having disk means arranged in recesses in the sidewalls of the housing and turning shaft pins, said, disk means having concentric recesses arranged therein, and inserts of foamed synthetic material provided as installed in the recesses, which inserts of foamed synthetic material during running operation move along counter-running surfaces of the sidewalls.

5. A rotary piston blower according to claim 4 in which with half-roller blowers the recesses on a side of the lobe have a smaller axial depth than the recesses on the side of the piston with a small radius.

6. A rotary piston blower according to claim 1 having identically shaped pistons which have two lobes with convex running surfaces and between these having concave running surfaces, said convex running surfaces being formed by foamed material bodies.

7. A rotary piston blower according to claim 1 in which screw-shaped pistons having an external tooth-shaped spiral running surface of one piston and sides of the thread pitch course of the counter piston being formed by foamed material bodies.

8. A rotary piston blower according to claim 1 in which the running surfaces negatively loaded by centrifugal force are formed by foamed material bodies.

* * * * *